US007604016B2

(12) United States Patent
Songest

(10) Patent No.: US 7,604,016 B2
(45) Date of Patent: Oct. 20, 2009

(54) COLLAPSIBLE VEHICLE COVER

(75) Inventor: Anthony Donald Songest, New South Wales (AU)

(73) Assignee: Creative Car Products PTY Ltd, Palm Beach (AU)

( * ) Notice: Subject to any disclaimer, the term of this patent is extended or adjusted under 35 U.S.C. 154(b) by 480 days.

(21) Appl. No.: 10/597,094

(22) PCT Filed: Jan. 12, 2005

(86) PCT No.: PCT/IB2005/050128

§ 371 (c)(1),
(2), (4) Date: Jul. 11, 2006

(87) PCT Pub. No.: WO2005/068752

PCT Pub. Date: Jul. 28, 2005

(65) Prior Publication Data

US 2009/0025768 A1 Jan. 29, 2009

(30) Foreign Application Priority Data

Jan. 12, 2004 (AU) ..... 2004900130
Jun. 30, 2004 (AU) ..... 2004903596

(51) Int. Cl.
*E04H 15/36* (2006.01)
*E04H 6/02* (2006.01)

(52) U.S. Cl. ..... 135/132; 135/88.06; 135/135; 135/117; 135/96; 296/136.13; 206/335

(58) Field of Classification Search ..... 135/88.06, 135/88.13, 88.15, 96, 97, 117, 132–133, 135/135–136, 120.3; 296/136.1, 136.11, 296/136.13, 129; 206/335; 52/63, 67
See application file for complete search history.

(56) References Cited

U.S. PATENT DOCUMENTS 2,598,940 A * 6/1952 Robie ..... 135/133
2,627,865 A * 2/1953 Mitchell ..... 135/132
2,856,942 A * 10/1958 Scott ..... 135/132
3,171,417 A * 3/1965 Stokes ..... 135/132
3,465,765 A 9/1969 Dietz
4,271,856 A * 6/1981 Ferguson ..... 135/132
4,683,900 A * 8/1987 Carmichael ..... 135/88.01
4,716,919 A * 1/1988 Griffin ..... 135/133

(Continued)

FOREIGN PATENT DOCUMENTS

AU 55146/90 A1 11/1990

(Continued)

OTHER PUBLICATIONS

International Search Report (Form PCT/ISA/210) mailed on Mar. 17, 2005.

(Continued)

*Primary Examiner*—Winnie Yip
(74) *Attorney, Agent, or Firm*—Harrity & Harrity, LLP

(57) ABSTRACT

A portable vehicle cover (10) includes a base frame (12) and a plurality of transversely extending hoop members (14). Each hoop member is adapted to be releasably connectable with the frame such that at least two of the hoop members substantially extend diagonally across the frame in a cruciform orientation. A flexible cover (16) is engagable with the hoop members to form a weather shield for a vehicle.

30 Claims, 6 Drawing Sheets

U.S. PATENT DOCUMENTS

| | | | | | |
|---|---|---|---|---|---|
| 4,886,083 | A | * | 12/1989 | Gamache | 135/88.06 |
| 4,887,397 | A | | 12/1989 | Peterson | |
| 5,740,826 | A | * | 4/1998 | Nevin et al. | 135/88.06 |
| 5,806,549 | A | * | 9/1998 | Love | 135/143 |
| 5,842,495 | A | * | 12/1998 | Egnew et al. | 135/133 |
| D418,573 | S | * | 1/2000 | Ju | D21/834 |
| 6,289,834 | B1 | * | 9/2001 | Phillips | 114/211 |
| D465,004 | S | * | 10/2002 | Funk et al. | D21/834 |
| 6,536,827 | B2 | * | 3/2003 | Oswald et al. | 296/39.2 |
| 6,892,742 | B2 | * | 5/2005 | Wang | 135/125 |

FOREIGN PATENT DOCUMENTS

| | | | |
|---|---|---|---|
| AU | 200012491 | A1 | 7/2000 |
| AU | 200022308 | A1 | 9/2001 |
| CN | 2321870 | Y | 6/1999 |
| CN | 2324230 | Y | 6/1999 |
| CN | 2510578 | Y | 9/2002 |
| DE | 28 48 077 | A1 | 5/1980 |
| DE | 298 18 300 | U1 | 5/1999 |
| EP | 0 555 791 | B1 | 9/1996 |
| FR | 1.313.259 | | 11/1962 |
| GB | 2 389 092 | A | 12/2003 |

OTHER PUBLICATIONS

International Preliminary Report on Patentability (Form PCT/IPEA/409) mailed on Dec. 5, 2005.

International Search Report from the Australian Patent Office for National Application No. 2004900130, dated Apr. 30, 2004, 2 pages.

* cited by examiner

COLLAPSIBLE VEHICLE COVER

FIELD OF THE INVENTION

The present invention relates to vehicle covers and in particular to vehicle covers that are collapsible and separable for transport.

The invention has been developed primarily as a collapsible vehicle cover for an automobile and will be described hereafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of common general knowledge in the field.

Portable covers for vehicles are known. In one for they comprise four stand members and rigid or flexible covers connectable with the stand members. The stand members are usually either secured to the ground or to the vehicle.

Other known portable vehicle covers include a base and a plurality of hoop members engageable with the base. A flexible cover is disposed above, and is secured to the hoop members to form a substantially enclosed structure.

One known portable vehicle cover of this type is disclosed in U.S. Pat. No. 4,886,083 (GAMACHE). Described, is a portable cover including a frame and a weather resistant flexible sheet attached thereto. The frame includes a plurality of hingedly connected transversely extending hoops arranged such that they support the flexible sheet over the base to form the vehicle cover. The cover is secured by driving the vehicle up onto wheel pads included as part of the base. A disadvantage of this portable vehicle cover is that it is not collapsible enough for easy transport in a kit form.

It is an object of the invention to overcome or ameliorate at least one of the disadvantages of the prior art, or to provide a useful alternative.

Moreover, it is an object of the invention in its preferred form to provide a portable vehicle cover that is easily collapsible, simple to erect and cheap to manufacture.

SUMMARY OF THE INVENTION

According to the invention there is provided a portable vehicle cover including:

a base frame;

a plurality of transversely extending hoop members, each hoop member adapted to be releasably connectable with the frame such that at least two of the hoop members substantially extend diagonally across the frame in a cruciform orientation; and a flexible cover engagable with the hoop members to form a weather shield for a vehicle.

It is preferred that the hoop members are substantially resilient such that they form substantially arcuate hoops when connected to the frame. Each hoop member is preferably formed from two or more releasably connectable pieces. Alternatively, each hoop member may be formed from a single continuous piece. One or more of the hoop members are preferably adapted to be hingedly connected to the base frame and more preferably two end hoop members are hingedly connected to the base frame.

Preferably, the flexible cover include a hoop engaging sleeve at each of its ends adapted to slidably engage with the end hoop members.

Preferably, the flexible cover is secured in an extended configuration by selectively affixing to the base frame utilising a plurality of flexible strap members having selectively adjustable lengths.

In a preferred form, the base frame includes two transversely spaced longitudinally extending elongate frame members. It is preferred that each elongate frame member is formed from two hingedly connected elongate portions. Preferably, each elongate frame member includes one or more, and desirably two, telescopingly connected extensions for selectively extending the length of the base frame.

Preferably, the portable vehicle cover includes one or more transversely extending flexible and selectively extendible tie members, for spacing apart the elongate frame members. It is preferred that these tie members take the form of flexible straps.

Preferably, the base frame includes four tyre pads for retaining the portable vehicle cover with respect to the vehicle. It is preferred that at least two of the tyre pads include two hingedly connected length adjustment portions. Desirably, at least two of the tyre pads are hingedly connected to the base.

Preferably, the base frame includes a plurality of hoop engaging sockets. It is preferred that four of the hoop engaging sockets are hingedly connected to the elongate frame members. It is fisher preferred that the hoop engaging sockets are angled outwardly away from the portable vehicle cover. It is desired that these sockets are inclined at an angle of between 10 and 20 degrees to the vertical plane. Preferably, releasable fasteners are used to retain one end of each hoop members in the hoop engaging sockets.

Preferably, the portable vehicle cover includes a hoop clamp for releasably clamping at least two hoop members. The hoop clamp is preferably permanently affixed to one hoop member. Preferably, the hoop clamp is in the form of a hub for receiving one or more ends of the releasably connectable hoop member pieces.

In a preferred form the portable vehicle cover includes a centrally extending hoop member, two diagonally extending hoop members and two pivotally connected end hoop members. Preferably, the centrally extending hoop member includes at least two pivotally connected extension arms for supporting said portable vehicle against the vehicle. Preferably, each extension arm has a selectively extendable length. It is further preferred that each extension arm has a suction cap at it distal end, the suction cap being engagable with the vehicle.

Preferably, each hoop member is formed from a substantially resilient material such as fibreglass or suitable plastic.

Preferably each elongate frame member is substantially formed from a tubular material and desirably formed from tubular aluminium.

BRIEF DESCRIPTION OF THE DRAWINGS

A preferred embodiment of the invention will now be described, by way of example only, with reference to the accompanying drawings in which.

DESCRIPTION OF THE PREFERRED EMBODIMENT

Figure 1:
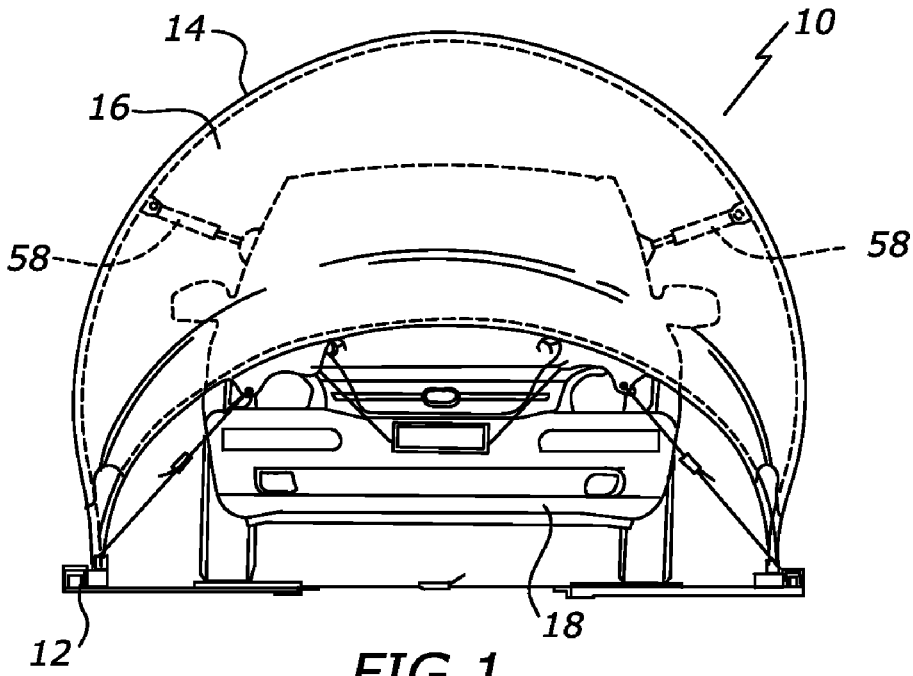
FIG. 1 is a front view of a portable vehicle cover according to the invention, shown fully assembled and with a vehicle inside.
Figure 2:
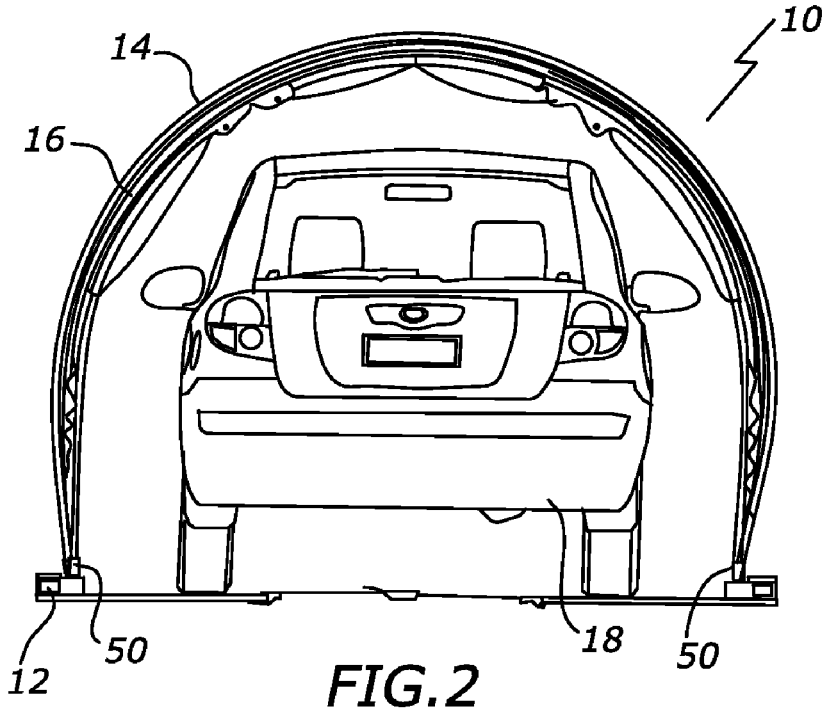
FIG. 2 is an end view of the portable vehicle cover of FIG. 1.

Referring to the accompanying drawings, the portable vehicle cover 10 includes a base frame 12 and five transversely extending hoop members 14. Each hoop member is releasably connectable with the base frame such that two hoop members extend diagonally across the frame in a cruciform orientation. The portable vehicle cover further includes a flexible cover 16, which engages with the hoop members to form a weather shield for a vehicle 18.

Figure 3:
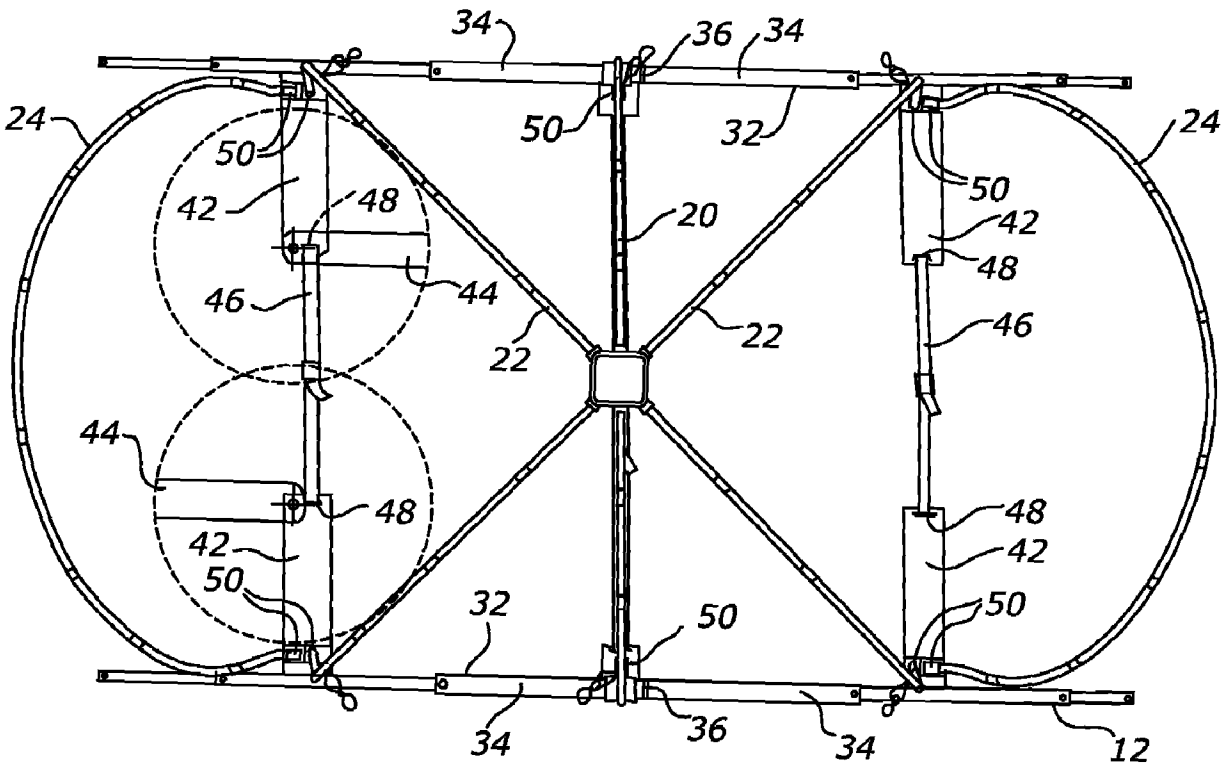
FIG. 3 is a plan view of a portable vehicle cover according to the invention, shown partly assembled.

As best shown on FIG. 3, the transversely extending hoop members 14 include a central 20, two diagonal 22 and two end hoop members 24. Each hoop member is constructed from a substantially resilient material, such as fibreglass or suitable plastic such that arcuate hoops are formed when they are connected to the base frame.

In the illustrated embodiment, each hoop member is formed from two or more releasably connectable pieces to facilitate transport in a kit. Alternatively, in another not shown embodiment, the hoop members are formed from a single continuous piece. The two end hoop members 24 are hingedly connected to the base frame to allow vehicle access when assembled.

Figure 6:
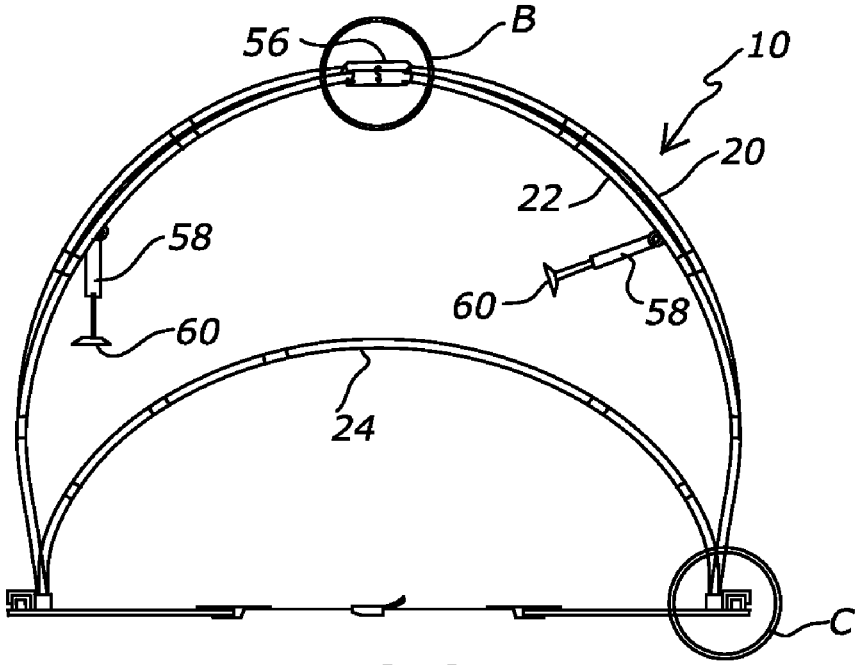
FIG. 6 is an end view of the portable vehicle cover of FIG. 3.
Figure 7:
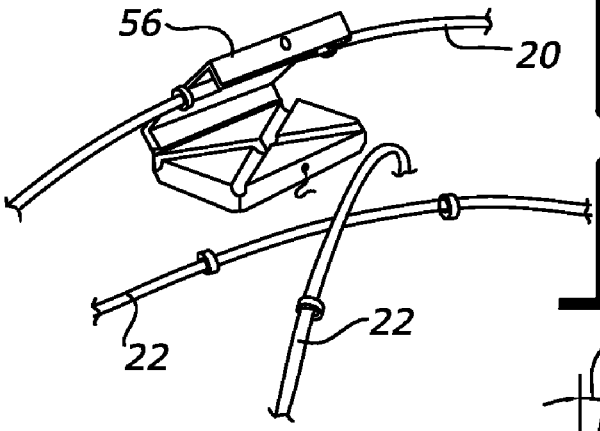
FIG. 7 is an enlarged exploded view of area B of FIG. 6.

Referring now to FIGS. 6 and 7, a hoop clamp 56 releasably clamps together the diagonally and central hoop members 22, 20 at their centres. In the illustrated embodiment, the hoop clamp is permanently fixed to the central hoop member 20.

Figure 11:
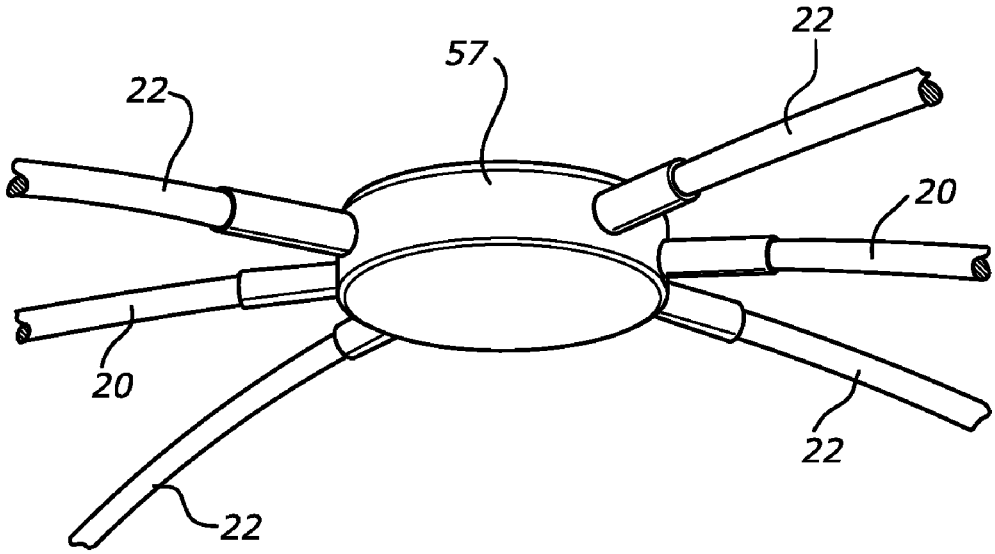
FIG. 11 is an enlarged perspective cut away view of a hub according to an alternate embodiment of the invention.

In an alternate embodiment shown in FIG. 11, the central and diagonal hoop members are discontinuous and the hoop clamp is in the form of a centrally disposed hub 57. In this case, the diagonal and central hoop members 22 and 20 each have one-half end releasably connected to the hub.

Figure 4:
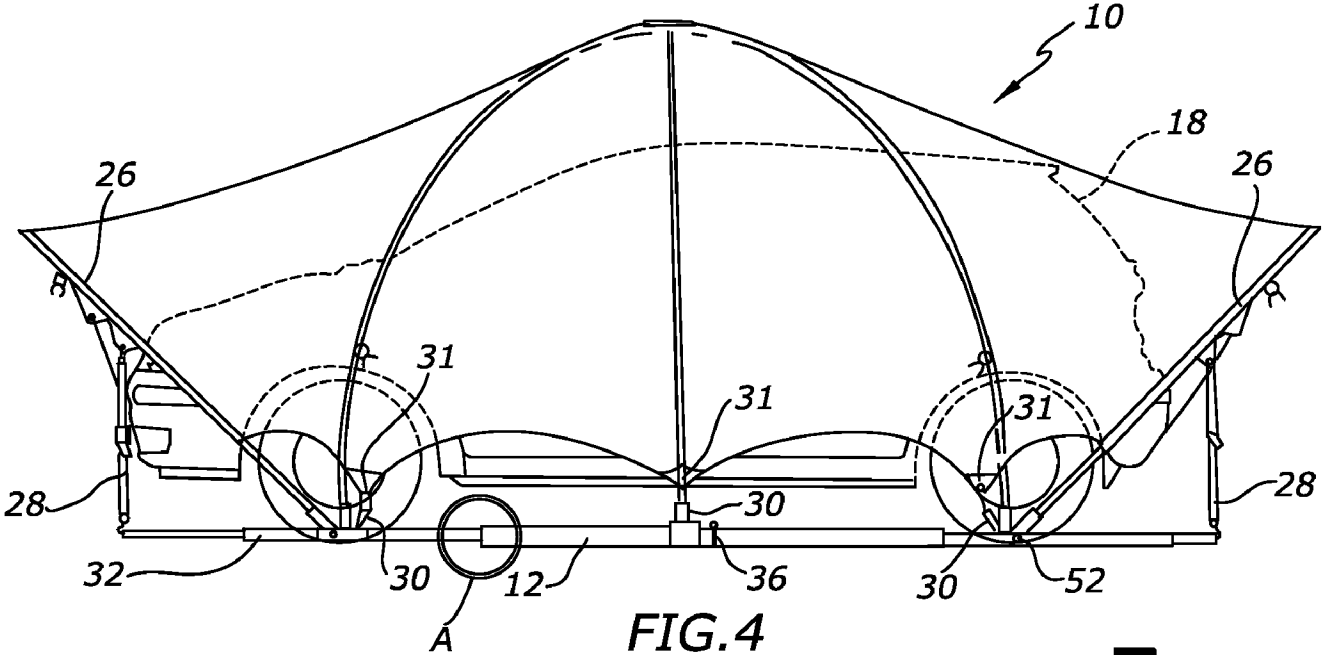
FIG. 4 is a side view of the portable vehicle cover of FIG. 1.

Referring to FIG. 4, the flexible cover 16 is formed a flexible material having favourable weather resistant properties. A securing means in the form of a hoop-receiving sleeve 26 is disposed at each end of the flexible cover. The hoop-receiving sleeve slidably receives the end hoop members 24 such that the flexible cover is secured in an extended configuration by selectively affixing to the base frame 12 using straps 28.

A plurality of flexible strap members 30, each having selectively adjustable lengths, is disposed about the base frame 12 and is used to retain the flexible cover to the base frame. The strap members are connectable with respective connecting points 31 on the flexible cover.

Figure 5:
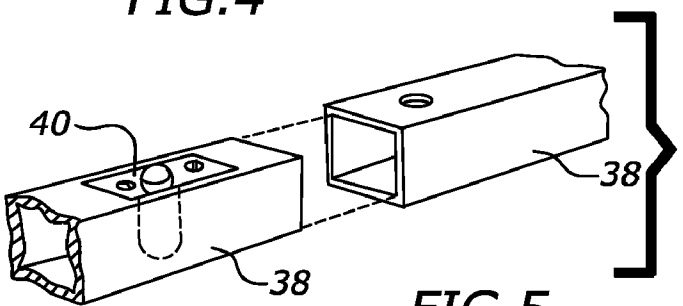
FIG. 5 is an enlarged perspective view of area A of FIG. 4.

Base frame 12 includes two transversely spaced and longitudinally extending elongate frame members 32. Each frame member is formed from two elongate portions 34 hingedly connected at hinge joint 36. A pair of telescopically connected extensions 38 is disposed at each end of the frame members for selectively extending the length of the base frame. As best shown in FIG. 5, the extensions 38 are retained in their extended states using ball catch joints 40. In an alternative not shown embodiment, the extensions 38 may be retained using other suitable securing means.

It is proposed that the frame members 32 be generally formed from aluminium or plastic tubes so as to facilitate their telescopic construction and easy manoeuvrability.

Figure 8:
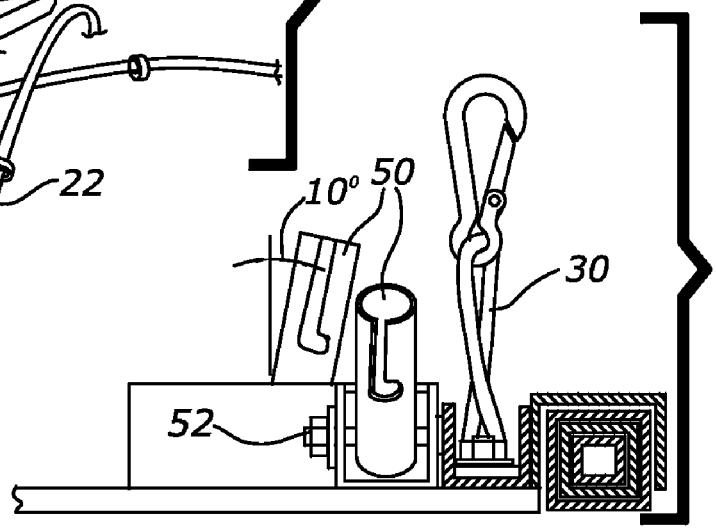
FIG. 8 is an enlarged view of area C of FIG. 6.

The base frame 12 further includes ten hoop engaging sockets 50 for retaining the ends of each hoop member 14 (FIG. 5). Four of the hoop engaging sockets are hingedly connected to the ends of the telescopic extensions 38 at hinge joints 52. As best shown on FIG. 8, the hoop engaging sockets are inclined outwardly at an angle of approximately 10° to the vertical plane so as to create the arcuate shape of the assembled vehicle cover 10.

Figure 10:
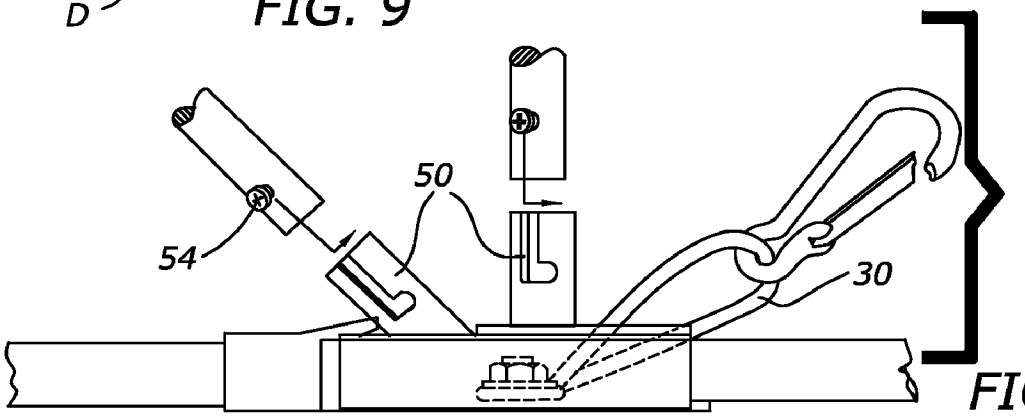
FIG. 10 is an enlarged view of area D of FIG. 9.

It will be appreciated that, due to the outward inclination of each hoop engaging socket and the lateral force applied on each socket by engagement with each resilient hoop member, frictional forces are advantageously used to retain hoop members ends in the sockets. However, in the case where additional security is required, a releasable fastening means such as releasable holding pins 54 is used FIG. 10).

Base frame 12 additionally includes four tyre pads 42 for retaining the portable vehicle cover 10 with respect to the vehicle 18. In the illustrated embodiment shown on FIG. 3, the tyre pads extend laterally from the frame members 32 at a location substantially adjacent to the diagonal hoop engaging sockets. Two of the tyre pads 42' include a hingedly connected length-adjusting portion 44 for accommodating vehicles with different wheelbases. Alternatively, tyre pads 42' are hingedly connected to the base frame to perform the same function.

Two transversely extending tie members, in the form of flexible straps 46, retain the frame members 32 in a fixed spaced apart relationship against the lateral force applied by the resilient hoop members. The flexible straps are releasably connected to the tyre pads or alternatively directly to the frame members (not shown), using hook connectors 48.

Referring now to FIGS. 1 and 6, a pair of support arms 58 are pivotally connected to the central hoop member 20, and are used to space the central hoop member 20 away from, and support the vehicle cover 10 against, the vehicle 18. Each support arm is selectively adjustable in length and has a window engaging suction cap 60 disposed at its distal end.

In use, the portable vehicle cover 10 is transported in a kit bag and therefore first requires assembly before use. The kit is assembled with reference to FIGS. 1 to 12, using the following method:

The two frame members 32 are laid down on a ground surface such that they are correctly spaced to suit the vehicle. Each of the telescoping extensions 38 can then be extended until the ball catch joints 40 snapingly lock them into their extended configuration. The hoop engaging sockets 50 are then ready to receive the ends of each hoop member 14.

The two hingedly connected length-adjusting portions 44 of two tyre pads 42' should then be rotated into the required position to suit the vehicle's wheelbase. The flexible straps 46 are then connected to the tyre pads and locked into position such to retain the transverse distance between the two frame members 32.

After assembling each hoop member 14 to its full length, the diagonal hoop members 22 and the central hoop member 20 can be installed in position by inserting their ends into respective sockets and securing using holding pins 54 (if so required). Hoop clamp 56 is then used to retain these three hoop members together. In the alternate embodiment shown in FIG. 11 where the hoop clamp is in the form of a hub 57, the diagonal and central hoop members are simply assembled around the hub and then inserted into their respective sockets.

After unrolling the flexible cover 16 (as it was stored in the kit), one end hoop member 24 is inserted into one of the hoop-receiving sleeves 26. This end hoop member is then inserted in one of the end hinged hoop engaging sockets 50. With the end hoop engaging socket rotated at an angle of approximately 90° to the horizontal, the other end of the end hoop member 24 is then bent over and inserted and secured in the transversely opposite hoop engaging socket. The process is then repeated for the other end hoop member, thereby extending the flexible cover.

Figure 9:
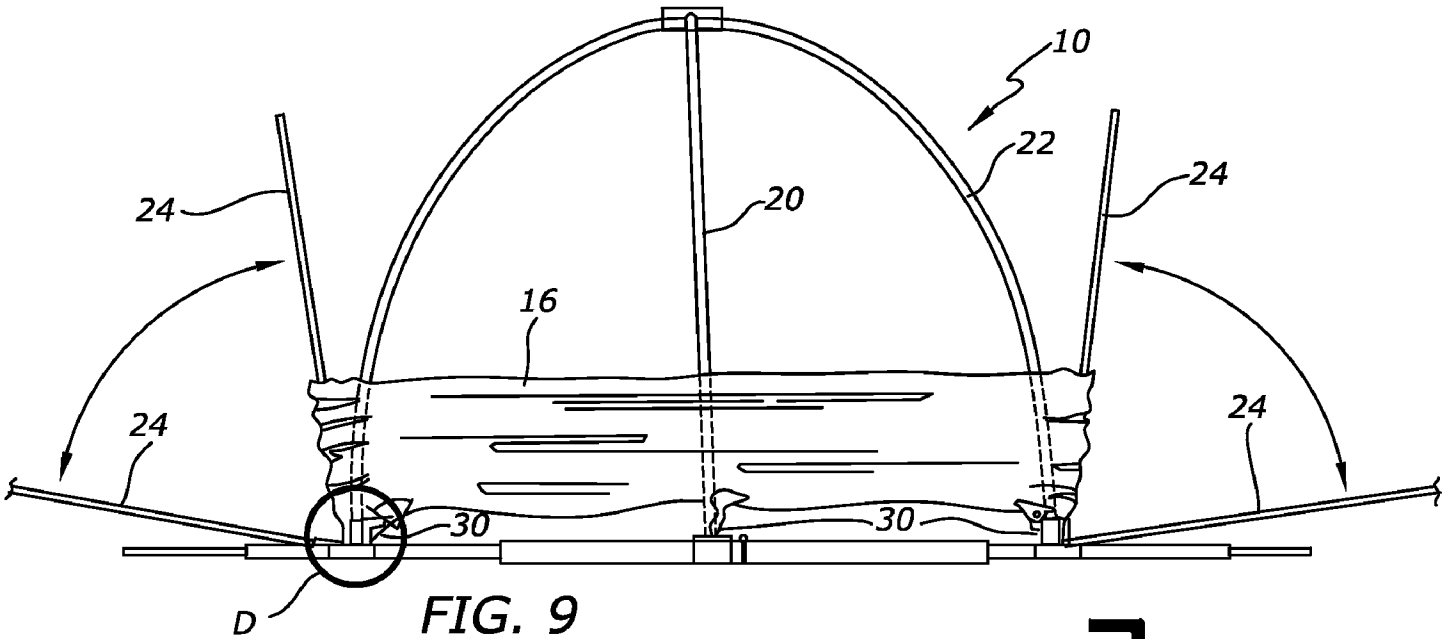
FIG. 9 is side view of a portable vehicle cover according to the invention, shown partly assembled.

As shown in FIG. 9, the flexible cover 16 can now be pulled over the assembled central and diagonal hoop members 20 and 22 to the other side of the base frame 10. When this is completed, the flexible cover is secured to the base frame using the plurality of flexible strap members 46.

One end hoop member is then rotated upwardly to 90° so that the vehicle 18 can be driven into the assembled vehicle cover 10 up until the driver's door aligns with pre-marked indicia (not shown) on both sides of the flexible cover 16. At this stage, the vehicle yes will be resting on the four tyre pads 42 and the portable vehicle cover should be sufficiently secured to the ground using the vehicle weight.

Once the driver exists the vehicle, the two pivotally connected extension arms 58 are positioned such that the suction cups 60 project onto, and engage with, the vehicle's driver's and front passenger's windows, thereby substantially restraining the assembled vehicle cover 10 against side loads.

As best shown in FIG. 4, the two end hoop members 24 are now both rotated downwardly, to approximately 45° to the vertical plane, and secured to each end of the elongate frame members using straps 28. Thus, the assembly process is completed and portable vehicle cover 10 is positively secured to the vehicle 18.

It will be appreciated that the illustrated portable vehicle cover provides a vehicle cover that is easy to assemble and cheap to manufacture. Advantageously, the illustrated portable vehicle is easily transportable in a kit form.

Although the invention has been described with reference to a specific example, it will be appreciated by those skilled in the art that the invention may be embodied in many other forms.

For example, in one alternate form there may be eight hoop members 14 to accommodate a vehicle of longer length, such as a small truck or SUV. In an alternate form, there may only be three hoop members required to accommodate a smaller vehicle.

It should be understood that the portable vehicle cover 10 may employ containers, secured to the frame, that hold water, sand or other suitable material to further secure the cover against extreme wind loads.

The invention claimed is:

1. A portable vehicle cover including:

a base frame;

a plurality of transversely extending hoop members, each hoop member being releasably connectable to the base frame, where the plurality of transversely extending hoop members includes at least two hoop members that substantially extend diagonally across the base frame in a cruciform orientation;

at least two hingedly connected vehicle tire engaging pads, where the vehicle tire engaging pads are adjustably rotatable about an axis perpendicular to a plane defined by the base frame to accommodate vehicles having different wheelbase lengths, and where the vehicle tire engaging pads secure the portable vehicle cover with respect to a vehicle when the vehicle is positioned on the tire engaging pads; and a flexible cover engagable with the plurality of transversely extending hoop members to form a weather shield for the vehicle.

2. A portable vehicle cover according to claim 1, where the plurality of transversely extending hoop members form substantially arcuate hoops when connected to the base frame.

3. A portable vehicle cover according to claim 1, wherein each one of the plurality of extending hoop members is formed from two or more releasably connectable pieces.

4. A portable vehicle cover according to claim 1, wherein each one of the plurality of extending hoop members is formed from a single continuous piece.

5. A portable vehicle cover according to claim 1, wherein one or more of the plurality of extending hoop members are hingedly connected to the base frame.

6. A portable vehicle cover according to claim 1, wherein said flexible cover is secured to base frame with a plurality of flexible strap members of selectively adjustable lengths.

7. A portable vehicle cover according to claim 1, wherein the base frame includes two transversely spaced longitudinally extending elongate frame members.

8. A portable vehicle cover according to claim 7, wherein each elongate frame member is formed from two hingedly connected elongate portions.

9. A portable vehicle cover according to claim 7, where each elongate frame member includes one or more telescopingly connected extension for selectively extending the length of said base frame.

10. A portable vehicle cover according to claim 9, where each elongate frame member includes two telescopingly connected extensions.

11. A portable vehicle cover according to claim 7, including one or more transversely extending, flexible and selectively extendible tie members for spacing apart the elongate frame members.

12. A portable vehicle cover according to claim 11, where the tie members are flexible straps.

13. A portable vehicle cover according to claim 7, where the base frame includes a plurality of hoop engaging sockets.

14. A portable vehicle cover according to claim 13, where four of the hoop-engaging sockets are hingedly connected to the elongate frame members.

15. A portable vehicle cover according to claim 13, where the hoop engaging sockets are angled outwardly away from the portable vehicle cover.

16. A portable vehicle cover according to claim 15, where the sockets are inclined at an angle of between 10 and 20 degrees to the vertical plane.

17. A portable vehicle cover according to claim 13, where each hoop engaging socket includes a releasable fastener for retaining the end of each hoop member.

18. A portable vehicle cover according to claim 7, where each elongate frame member is substantially formed from tubular aluminum.

19. A portable vehicle cover according to claim 1, where the at least two hingedly connected vehicle tire engaging pads comprise four vehicle tire engaging pads.

20. A portable vehicle cover according to claim 19, wherein at least two of the tire pads include two hingedly connected length adjustment portions.

21. A portable vehicle cover according to claim 19, where at least two of the tire pads are hingedly connected to the base frame.

22. A portable vehicle cover according to claim 1, where the portable vehicle cover includes a hoop clamp for releasably clamping at the least two hoop members.

23. A portable vehicle cover according to claim 22, where the hoop clamp is in a form of a hub for receiving one or more ends of the releasably connectable hoop member pieces.

24. A portable vehicle cover according to claim 1, where the hoop members are formed from a substantially resilient material.

25. A portable vehicle cover according to claim 1, further comprising:

at least two end hoop members hingedly connected to the base frame.

26. A portable vehicle cover according to claim 25, where the flexible cover includes a hoop engaging sleeve at each end of the flexible cover for slidably engaging with said the at least two end hoop members.

27. A portable vehicle cover according to claim 1, where the plurality of transversely extending hoop members further includes:

a centrally extending hoop member, and at least two pivotally connected end hoop members.

28. A portable vehicle cover according to claim 27, where the centrally extending hoop member includes one or more pivotally connected extension arms that support the portable vehicle cover against the vehicle, when the vehicle is positioned on the tire engaging pads.

29. A portable vehicle cover according to claim 28, where each of the one or more pivotally connected extension arms includes a selectively extendable length.

30. A portable vehicle cover according to claim 28, where each of the one or more pivotally connected extension arms includes a suction cap at a distal end for engaging the vehicle.

* * * * *

UNITED STATES PATENT AND TRADEMARK OFFICE

CERTIFICATE OF CORRECTION

PATENT NO. : 7,604,016 B2
APPLICATION NO. : 10/597094
DATED : October 20, 2009
INVENTOR(S) : Anthony Donald Songest It is certified that error appears in the above-identified patent and that said Letters Patent is hereby corrected as shown below:

Claim 1, column 5, line 58, delete the word "connectable" and insert --connected--;
line 63, after "pads" delete ",";
line 64, delete "where the vehicle tire engaging pads are" and insert --extending laterally from the base frame, each of the tire engaging pads including a length adjustment portion--;
line 67, after "lengths" delete "," and insert --;--, after "and" delete "where the vehicle tire";

Claim 1, column 6, lines 1-3, delete "engaging pads secure the portable vehicle cover with respect to a vehicle when the vehicle is positioned on the tire engaging pads; and".

Claim 3, column 6, line 10, delete the word "wherein" and insert --where--.

Claim 4, column 6, line 13, delete the word "wherein" and insert --where--.

Claim 5, column 6, line 16, delete the word "wherein" and insert --where--.

Claim 6, column 6, line 19, delete the word "wherein" and insert --where--.

Claim 7, column 6, line 22, delete the word "wherein" and insert --where--.

Claim 8, column 6, line 25, delete the word "wherein" and insert --where--.

Claim 26, column 7, line 16, remove the word "said".

Signed and Sealed this

Twenty-second Day of December, 2009

David J. Kappos

David J. Kappos
*Director of the United States Patent and Trademark Office*